United States Patent [19]

Lewis et al.

[11] 4,310,954

[45] Jan. 19, 1982

[54] BUCKLE

[75] Inventors: John W. R. Lewis, Sevenoaks; Mark E. Esner, Wembley, both of England

[73] Assignee: Howard Wall Limited, London, England

[21] Appl. No.: 93,224

[22] Filed: Nov. 13, 1979

[30] Foreign Application Priority Data

Nov. 16, 1978 [GB] United Kingdom ..... 44722/78

[51] Int. Cl.[3] ..... A44B 11/25

[52] U.S. Cl. ..... 24/230 A

[58] Field of Search ..... 24/230 A, 230 AL, 230 AK, 24/230 AP, 230 AS, 230 AT, 230 R

[56] References Cited

U.S. PATENT DOCUMENTS

| | | | |
|---|---|---|---|
| 3,895,196 | 7/1975 | Lewis | 24/230 A |
| 4,004,115 | 1/1977 | Esner | 24/230 AL |
| 4,065,836 | 1/1978 | Stephenson | 24/230 A |
| 4,069,557 | 1/1978 | Loomba | 24/230 AL |
| 4,096,606 | 6/1978 | Stephenson | 24/230 A |
| 4,136,425 | 1/1979 | Esner | 24/230 A |

FOREIGN PATENT DOCUMENTS

| | | |
|---|---|---|
| 2801593 | 1/1979 | Fed. Rep. of Germany . |
| 2740458 | 3/1979 | Fed. Rep. of Germany . |
| 2803851 | 3/1979 | Fed. Rep. of Germany . |
| 2349296 | 11/1977 | France . |

*Primary Examiner*—Francis K. Zugel
*Assistant Examiner*—Alexander Grosz
*Attorney, Agent, or Firm*—Shoemaker and Mattare, Ltd.

[57] ABSTRACT

A seat belt buckle has a latch plate provided with a locking tooth which is biassed into engagement with an aperture in a locking plate, and is provided with a slider operated lever to move the latch plate to release the locking plate. A protrusion is provided on the slider which lies adjacent a portion of the latch plate when in the locking position to prevent the latch plate being disengaged from the locking plate even if the device is subjected to a sudden shock.

8 Claims, 15 Drawing Figures

BUCKLE

BACKGROUND OF THE INVENTION

This invention relates to anchoring devices, and particularly to devices for anchoring to the floor, seat or other part of a vehicle or aircraft, a lug or plate attached to a safety belt or harness.

Such a lug or plate, referred to hereinafter as a "plate", is usually provided with one or more apertures, or one or more notches, which is or are engaged by one or more teeth provided in the anchoring device, and with one or more slots to which one or more strap ends can be attached, the strap end or ends forming part of a safety belt or harness.

It has been proposed to provide an anchoring device which comprises a casing with a mouth into which can be placed that part of the plate carrying the aperture or notches, a latch plate carrying the tooth or teeth which engage the aperture or notches in the plate, a lever or levers which, when operated moves or move the latch plate to release the plate from the buckle, and an element, referred to hereinafter as a "slider", which can be moved manually against the action of a spring to operate the lever or levers to move the latch plate to allow the plate to be ejected from the buckle.

A disadvantage of some prior proposed buckles of this type is that the plate can be released from the buckle if the buckle is subjected to a transverse shock, i.e. a shock in a direction perpendicular to the plane of the plate.

OBJECT OF THE INVENTION

The present invention seeks to provide a buckle in which this disadvantage is obviated or reduced.

SUMMARY OF THE INVENTION

According to this invention there is provided a buckle for holding a plate having an aperture or notch and means by which it can be attached to a vehicle safety belt or harness, said buckle comprising a casing which has a mouth into which can be placed that part of the plate which carries the aperture or notch, a latch plate movably mounted within the casing which carries a tooth to engage said aperture or notch to secure the plate in position, and a slider which is mounted in the casing for sliding from a first position in which, when the latch plate is in the securing position, a member associated with the slider lies immediately adjacent a portion of the latch plate to prevent the latch plate moving from the securing position, to a second position in which the latch plate is moved from the securing position to a release position to release the plate.

Preferably at least one lever is provided which is operated by the slider, the lever operating to swing the latch plate to move the tooth out of the said aperture or notch.

Advantageously when the plate is locked within the buckle the surface of the plate nearer the slider may be nearer to the slider than the end of the lever remote from the slider.

Preferably a spring biased ejector is provided tending to eject the plate from the buckle, the ejector lying under the said tooth when the plate is not in the casing, retaining the latch plate in the release position.

Advantageously the said member associated with the slider is a protrusion formed on the slider. Conveniently the slider slides in a direction parallel to the plane of the plate, and said protrusion may engage a portion of the latch plate when the latch plate is in the release position, thus retaining the slider in a retracted position.

The lever can be hook shaped.

The buckle can have two levers which can be mounted on a rod carried in holes in the walls of a channel and the levers can be outside the walls of the channel and engage arms on the latch plate which arms pass through apertures in the walls of a channel.

Preferably the portion of the latch plate adjacent which the member associated with the slider lies, comprises the arms of the latch plate.

A spring can be provided to bias the latch plate to a locking position, the spring also holding the latch plate against its fulcrum in the walls of the channel.

BRIEF DESCRIPTION OF THE DRAWINGS

In order that the invention may be more readily understood and so that further features thereof may be appreciated the invention will now be described by way of example with reference to the accompanying drawings in which.

DESCRIPTION OF PREFERRED EMBODIMENTS

Figure 1:
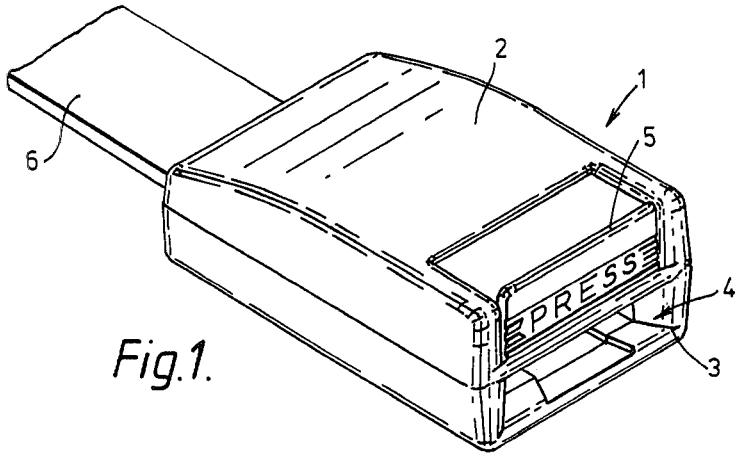
FIG. 1 is a perspective view of an assembled buckle in accordance with the invention.
Figure 2:
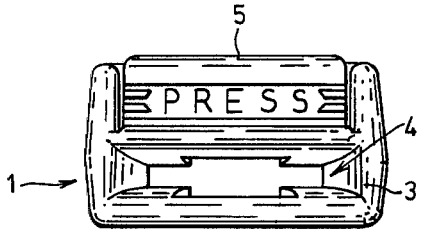
FIG. 2 is an end view of the buckle shown in FIG. 1.

Referring to FIGS. 1 and 2 of the accompanying drawings a buckle 1 for use in connection with a vehicle seat belt or the like comprises an outer casing 2 formed of a plastics material. The casing 2 includes a lip section 3 which defines a mouth 4. A slider member 5 is slidably mounted in the casing 2 and may be pressed so that the slider member slides inwardly of the casing 2. Means, such as webbing belt 6 are securely connected to a component within the casing 2 and serve to connect the buckle securely to part of a motor vehicle, aircraft or the like.

Figure 3:
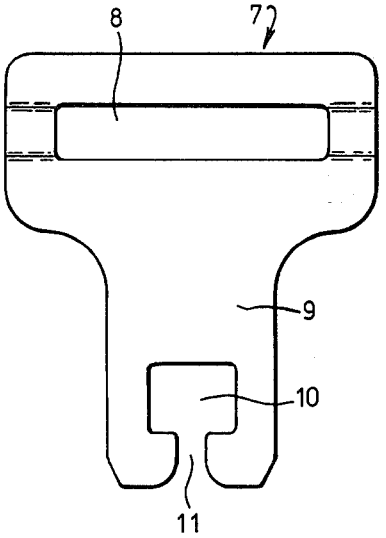
FIG. 3 is a plan view of a plate which can be used with the buckle shown in FIGS. 1 and 2.
Figure 13:
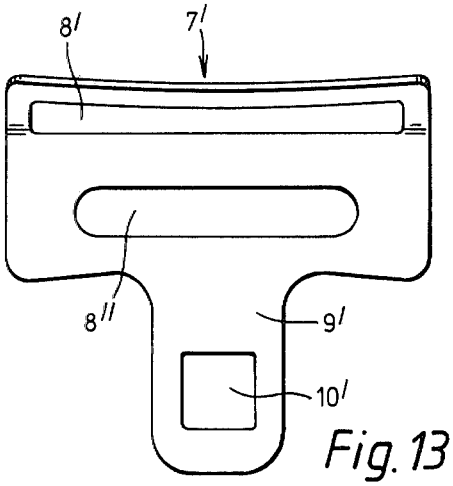
FIG. 13 is a plan view of a plate for use with the buckle of FIG. 10.

The buckle shown in FIGS. 1 and 2 is intended for use with a plate 7 as shown in FIG. 3. The plate 7 has a first rectangular portion which defines a rectangular slot 8 and a portion of a seat belt or the like may be passed through the slot 8 and subsequently the sewn so that the plate 7 is securely connected to the seat belt. The plate 7 defines a protruding tongue portion 9, and at the free end of this tongue portion 9 is a substantially square aperture or notch 10 which is connected to the free end of the tongue portion 9 by a channel 11. Thus the aperture 10 and channel 11 together form a "T" shaped slot.

Figure 4:
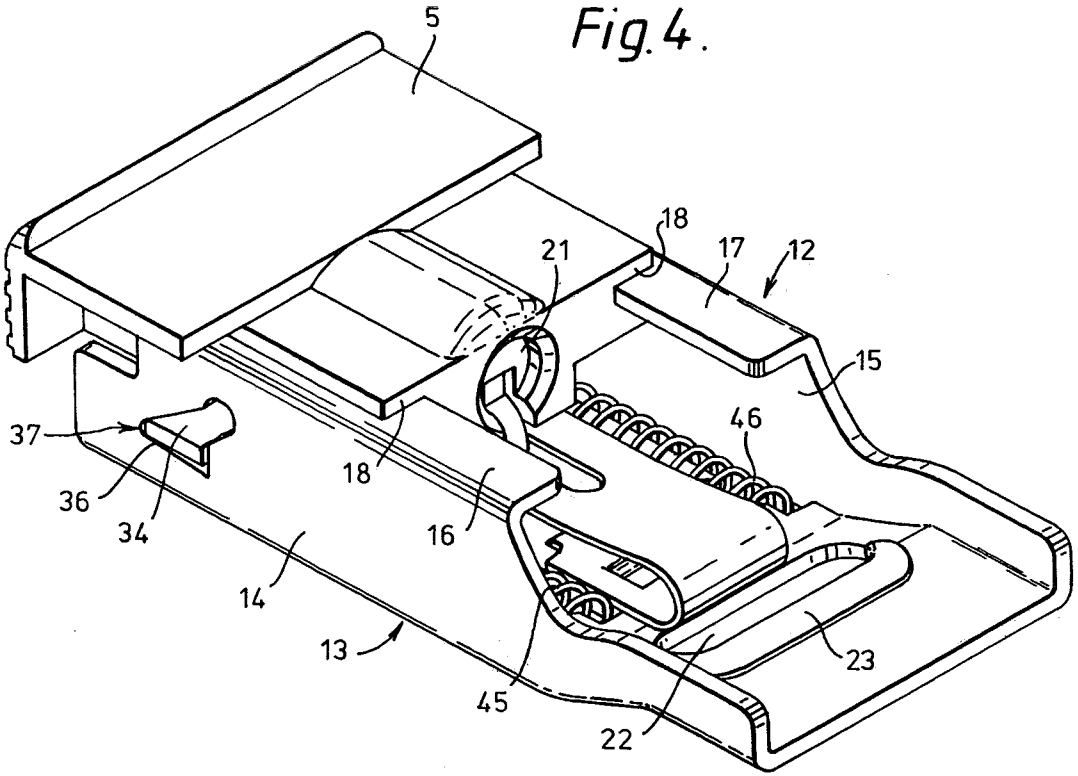
FIG. 4 is a perspective view of part of the buckle shown in FIGS. 1 and 2 with the casing removed to show the relative disposition of various components.
Figure 5:
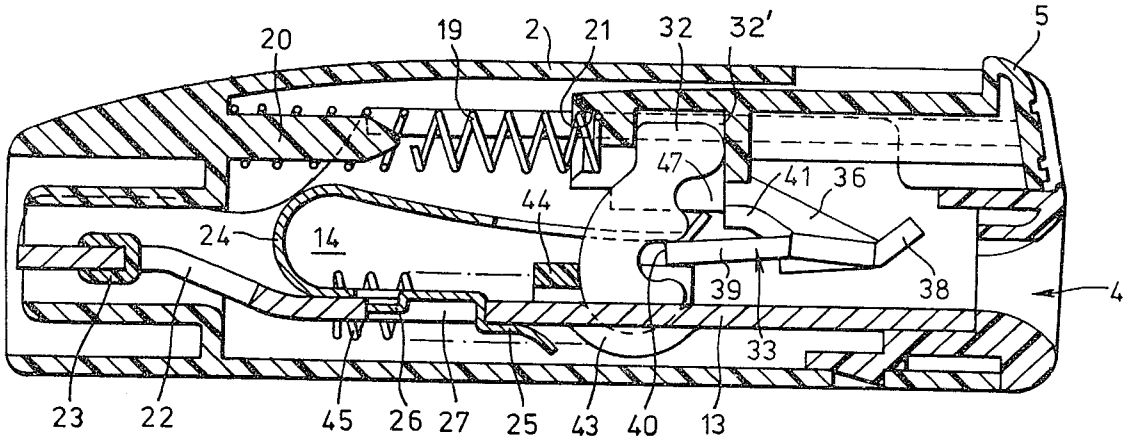
FIG. 5 is a vertical part sectional view of the buckle shown in FIG. 4 showing the condition of the buckle before a plate is inserted.
Figure 6:
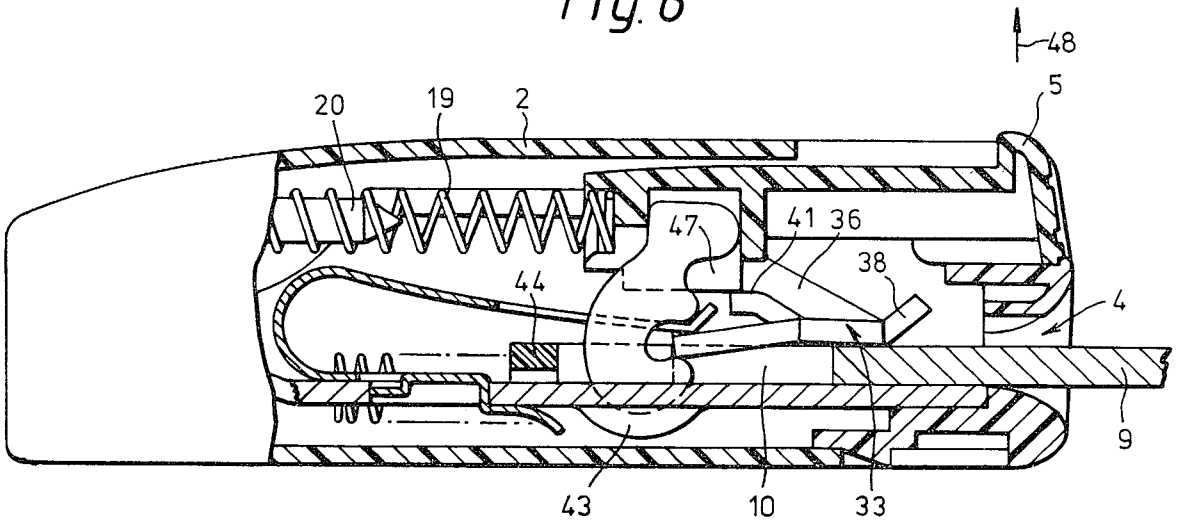
FIG. 6 is a part sectional view corresponding to FIG. 5 but showing the plate inserted in the buckle.

Located within the casing 2 is a channel member 12 formed of strong metal which can be most clearly seen in FIG. 4 of the accompanying drawings. The channel member has a substantially flat base 13, and two vertically upstanding side walls 14, 15, the side walls terminating into opposed inwardly directed flanges 16, 17. The slider member 5 is provided with grooves 18 in the side edges thereof, and the grooves 18 engage the inwardly directed flanges 16, 17 so that the slider member 5 may slide along the flanges 16, 17. A compression spring 19 as shown most clearly in FIGS. 5 and 6 is provided which extends between a spigot 20 formed on the casing 2 and a recess 21 formed in the rear surface of the slider member 5. The compression spring 19 serves to bias the slider member forwardly, that is to say to the right with the buckle in the orientation shown in FIGS. 5 and 6.

An aperture 22 is formed in the base 13 of the channel member 12 towards the rear thereof, the rearmost lip of this aperture being protected by a plastics material sleeve 23. The aperture 22 is intended to accommodate one end of the strap 6 that is used to secure the buckle 1 to a motor vehicle, aircraft or the like.

Figure 8:
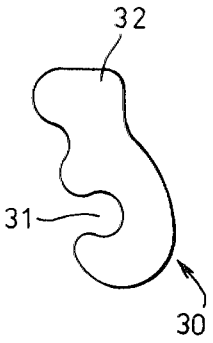
FIG. 8 is a side elevational view of a hook member forming part of the buckle of FIGS. 1 to 6.
Figure 7:
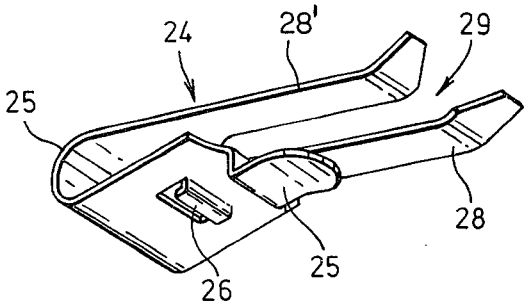
FIG. 7 is an underneath perspective view of a spring forming part of the buckle shown in FIGS. 1 to 6.

A latch plate biassing spring 24 is provided, the spring 24 having resilient tongues 25, 26 which are adapted to engage the edge of an aperture 27 formed in the base 13 of the channel 12 to secure the spring 24 in position. The spring 24 has a curved portion 25 which extends into two resilient parallel fingers 28', 28, the fingers being spaced apart to define a gap 29. The gap 29 is sufficiently wide to accommodate a hook member 30 shown in FIG. 8, the hook member having a recess 31 adapted to engage a latch plate as will be described hereinafter and a head portion 32 adapted to engage a camming slot 32' formed in the slider 5 as will again be described hereinafter in greater detail.

Figure 9:
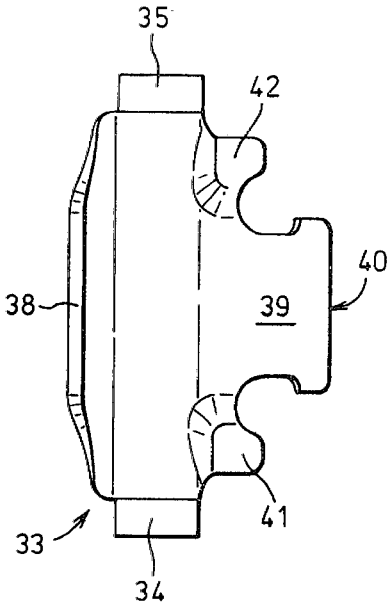
FIG. 9 is a plan view of a latch plate forming part of the buckle of FIGS. 1 to 6.
Figure 12:
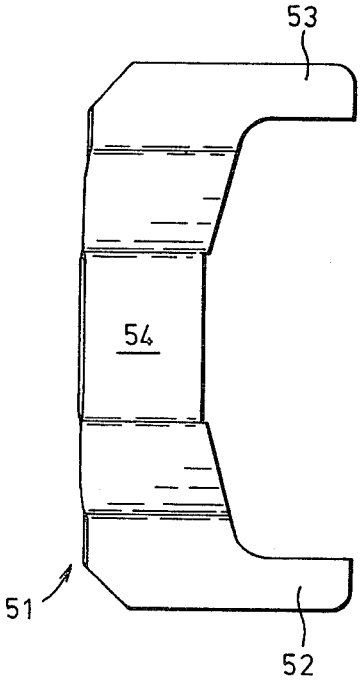
FIG. 12 is a plan view of a latch plate forming part of the buckle of FIG. 10.

A latch plate 33 is provided, the latch plate being illustrated most clearly in FIG. 9 of the accompanying drawings the latch plate has, on two opposed side edges thereof, lugs 34, 35. These lugs are dimensioned to be accommodated in apertures 36 formed in the side walls 14, 15 of the channel 12. The arrangement is such that, with the lugs 34, 35 in position the latch plate is free to pivot or tilt about the forwardmost ends of the lugs, namely about the fulcrum point 37 indicated in FIG. 4 of the accompanying drawings. The latch plate 33 is held against this fulcrum point by the spring 24. The latch plate 33 has an upwardly directed forward portion 38, this forward portion being located adjacent the mouth 4 of the assembled buckle. The upwardly directed forward portion 38 extends forwardly from a substantially planar portion which interconnects the two lugs 34, 35. On the opposite side of this planar portion in the central region is a downwardly directed locking tooth 39 the rear edge 40 of which is intended to engage a side wall of the aperture 10 formed in the plate 7 to lock the plate 7 to the buckle. The latch plate 33 also includes two relatively elevated lands 41, 42, located on either side of the locking tooth 39.

Defined in the underside of the slider 5 is a recess or camming slot 32' in which the head 32 of the hook shaped member 30 is located. A curved lower portion of the hook shaped member 30 is located in a correspondingly shaped depression 43 formed in the substantially flat base 13 of the channel 12. Thus the hook shaped member is substantially perpendicular to the base 13 of the channel 12. As the slider slidingly moves along the inwardly directed flanges 16, 17, the head 32 of the hook member 30 is engaged by the camming slot 32' and the hook member 30 rotates within the depression 43. It is to be noted that the free end portion of the locking tooth 39 is located within the recess 31 of the hook shaped member 30, as can be clearly seen in FIGS. 5 and 6.

A locking plate ejector member 44 is provided which is slidably movable along a track defined by the base 13 of the channel member 12, the ejector member 44 being biassed forwardly by means of compression springs 45, 46 that are mounted on spigots defined by apertures formed in the substantially flat base 13 of the channel member 12.

Two protrusions 47 are formed symmetrically on the underside of the slider member 5, the protrusions 47 being formed integrally with the slider member. The protrusions 47 are located in alignment with lands 41.

FIG. 5 illustrates the above described buckle when in a condition ready to receive the plate 9. It is to be noted that the locking tooth 39 is resting on top of part of the ejector 44. Also the two protrusions 47 formed on the underside of the slider 5 engage the side edges of the portions of the latch plate defining lands 41. Thus the slider cannot move fully to the right by virtue of engagement of the protrusions 47 with the side edges of lands 41. When it is desired to connect the seat belt to the buckle the tongue 9 of the plate 7 is inserted in a mouth 4 of the buckle and if the tongue is inclined upwardly the tongue initially engages the upwardly directed portion 38 of the latch plate 33 and thus the tongue portion is guided into a predetermined channel. The free end of the tongue 9 engages the ejector 44 and pushes the ejector rearwardly, that is to say, to the left as shown in FIGS. 5 and 6, thus compressing the springs 45, 46. The hook member 30 passes into the channel 11 in the tongue 9 of plate 7. Under the influence of the resilient fingers 27, 28 of the spring 24 the latch plate is biassed downwardly and as soon as the aperture 10 is located underneath the locking tooth 39 the locking tooth moves downwardly, the entire plate 33 pivoting about the point 37, and thus the side edge 40 of the locking tooth 39 moves into engagement with a portion of the wall defining the aperture 10 as can be seen most clearly in FIG. 6. As the latch plate 33 pivots downwardly the lands 41 move below the protrusions 47 formed on the slider and the slider thus moves forwardly under the biassing effect of the spring 19 to occupy a forwardmost position as illustrated in FIG. 6. As can be seen from FIG. 6 the protrusions 47 are now located directly above the lands 41 and the plate 9 is locked securely in position. Even if the buckle is subjected to a severe blow or force imparting an acceleration on the latch plate in the direction of arrow 48 in FIG. 6 the latch plate will not move upwardly to release the plate 9 since the lands 41 are engaged by the protrusions 47 formed on the bottom of the slider 5. Thus the latch plate 33 is effectively locked in position. When the buckle is in this condition the surface of the plate 7 that is nearest the slider 5 is closer to the slider 5 than is the end of the hook shaped member that is remote from the slider.

When it is desired to release the plate 9 the slider 5 is merely pressed inwardly, thus causing the hook shaped member 30 to rotate in the recess 43. Since the locking tooth 39 is located in the recess 31 formed in the hook shaped member 30, on rotation the hook shaped member 30 the locking tooth is lifted upwardly, and since the slider has been pressed inwardly the protrusions 47 are no longer located over lands 41 and thus the latch plate 33 is free to move upwardly. Consequently the end surface 40 of the locking tooth 39 is removed from the aperture 10 and thus the plate 9 will be ejected from the buckle under the biassing effect of compression springs 45, 46. The ejector 44 is now located under the free end of the locking tooth 39 maintaining the latch plate in the position indicated in FIG. 5. When the slider 5 is released the slider moves forwardly under the biassing effect of spring 19 until the protrusions 47 on the slider again engage the side edges of lands 41, thus retaining the slider in the position illustrated in FIG. 5 of the accompanying drawings.

It will be appreciated that in the above described embodiment of a buckle the buckle will be able to withstand forces applied to the buckle in the direction of arrow 48 without releasing the plate 9, but the buckle will still be relatively straightforward to manufacture and will be easy to use. It is the co-operation of the protrusions 47 on the slider 5 and the elevated lands 41 on the latch plate 33 that provides the above described desired advantageous result.

Turning now to FIGS. 10 to 15 a second embodiment of a buckle in accordance with the invention will be described. The external appearance of this buckle is similar to the external appearance of the buckle illustrated in FIGS. 1 and 2. The buckle comprises a casing 2' at which has a lip section 3' defining a mouth 4'. The buckle is also provided with a slider member 5' which is adapted to slide into the casing 2'. Within the casing is a channel member 12' formed of strong metal and which has a substantially flat base 13' and two upstanding side walls 14', 15', which terminate in two inwardly directed flanges 16', 17' on which the slider 5' slides. An ejector 44' is provided for ejecting a plate from the buckle and this ejector is biased by a spring 46' which is maintained in position on a spigot formed by part of the flat base 13' of the channel 12'.

Figures 10, 11:
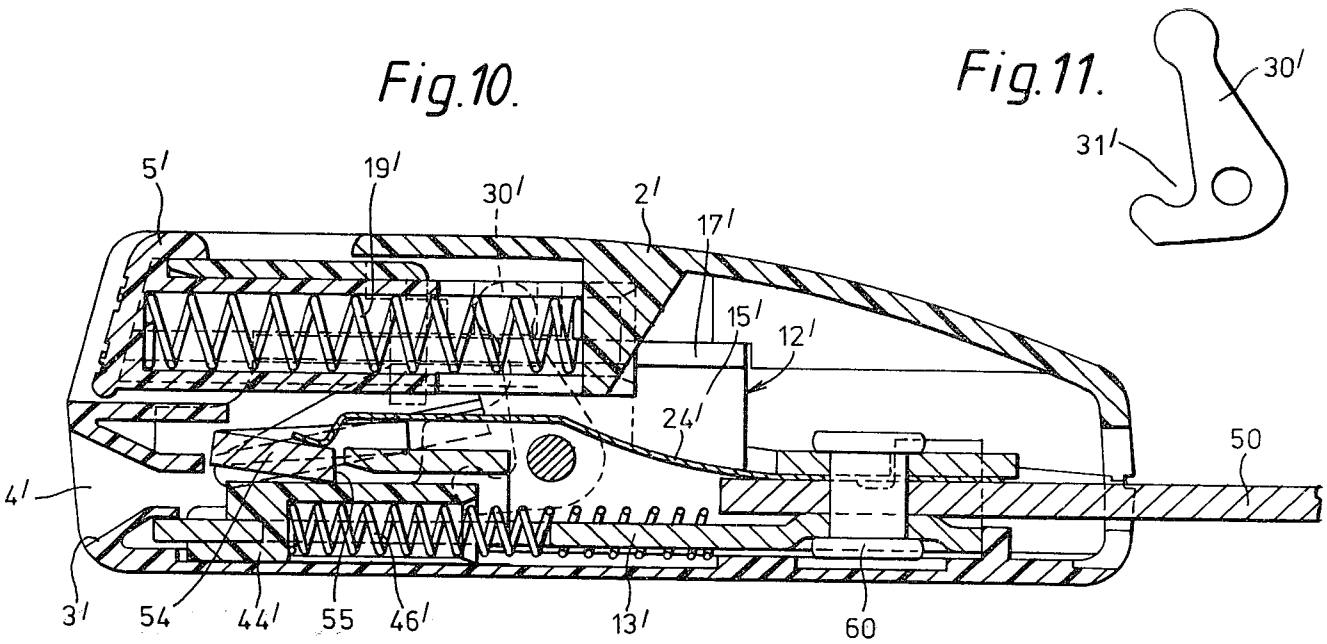
FIG. 10 is a cross-sectional view of a second embodiment of the buckle in accordance with the invention.
FIG. 11 is a side elevational view of a hook shaped member forming part of the buckle of FIG. 10.

The slider 5' is provided with a spring 15' which biasses the slider towards a forward position, that is to say to a left hand position as illustrated in FIG. 10.

Figure 15:
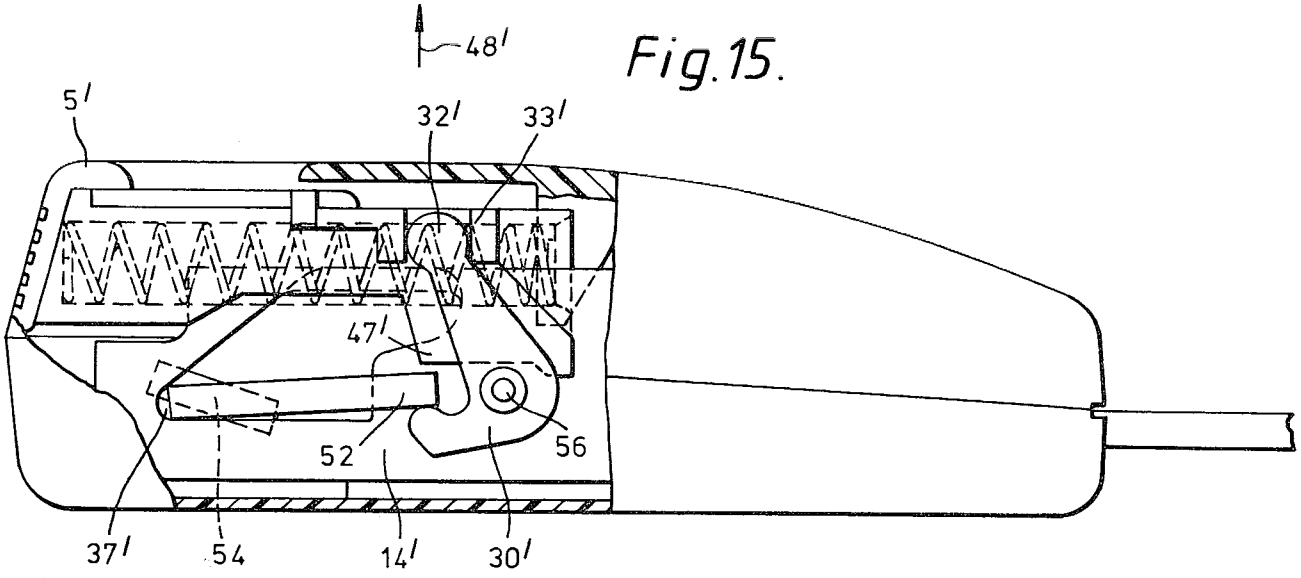
FIG. 15 is a view corresponding to FIG. 14 showing the position of various components of the buckle after the latch plate has been inserted.

In the embodiment illustrated in FIG. 10 the buckle is mounted on a portion of a motor vehicle by means of a rigid metal member 50 that is riveted 60 to an aperture formed in the base 13' of the channel member 12'. The rivet also mounts in position a latch plate biassing spring 24'. A latch plate 51 is provided, the latch plate comprising a generally rectangular section adapted to extend transversely of the buckle and two rearwardly extending arm portions 52, 53 adapted to extend rearwardly towards the metal member 50, the rearwardly extending arm portions 52, 53 being located on the outside of the side walls 14', 15' of the channel member 12'. One of the rearwardly extending arm portions 52 can be seen in FIG. 15. The two rearwardly extending arm portions 52, 53 are co-planar, but the central portion of the rectangular region extending therebetween forms a locking tooth 54, this locking tooth being inclined downwardly and rearwardly relative to the plane containing the rearwardly extending arm member 52, 53. The rear surface 55 of the locking tooth 54 is intended to engage with a square aperture 10' formed in a protruding tongue portion 9' of a plate 7' shown in FIG. 13 of the accompanying drawings, which defines two rectangular slots 8',8'' for accommodating a webbing strap. Two hook shaped members 30' are provided in this embodiment of the invention, the hook shaped members being located, as can be seen in FIG. 15, on the exterior of the channel, the hook shaped members being mounted for pivotal movement on an axis 56 that extends transversely across the channel, and through apertures formed in the side walls of the channel. A recess 31' defined by each the hook shaped member 30' engages the free end of the respective rearwardly extending arm portion 52, 53 of the latch plate 51 on either side of the channel member. A head portion 32' of each hook shaped member 30' is located within a respective recess or camming slot 33' defined by the slider 5'. The slider member 5' also defines downwardly extending protrusions 47' located on either side of the channel member 12' the protrusions 47' being adapted to be located immediately above the free ends of the rearwardly extending arm portions 52, 53 of the latch plate 51.

Figure 14:
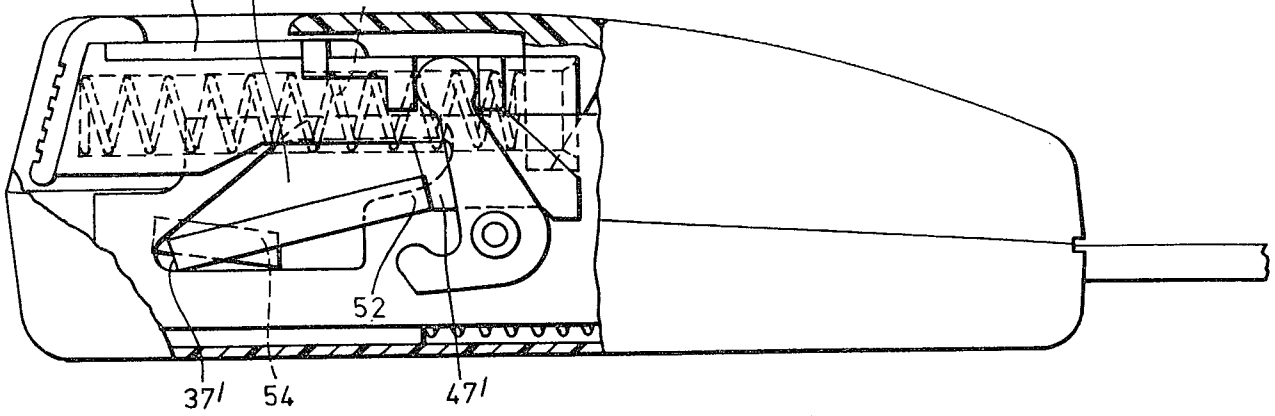
FIG. 14 is a side elevational view of the buckle of FIG. 10 with parts thereof cut away showing the position of certain components before the plate of FIG. 13 has been inserted into the buckle.

Referring now specifically to FIGS. 10 and 14 which illustrate the buckle in a condition ready to receive the plate 7' it can be seen that the ejector 44' is in a forwardmost position, having been biassed to that position by spring 46', and the locking tooth 54 rests on the top of the ejector 44 thus maintaining the latch plate in a relatively elevated position. Of course, portions of the latch plate 51 pass through apertures 36' formed in the side wall portions 14', 15' of the channel member 12' and the latch plate is free to pivot about a fulcrum point 37'. The latch plate 51 is held against the fulcrum point 37' by the spring 24'. With the buckle in the position illustrated in FIGS. 10 and 14 the slider 5' is biassed forwardly by spring 19' but a portion of the downwardly directed protrusion 47' on either side of the channel member 12' engages the end of the corresponding rearwardly extending arm portion 52 or 53. Thus the slider 5' cannot move to the fully extended position.

As the plate 9' is inserted into the mouth 4' of the buckle the end of the plate will engage the ejector 44' and will thus compress the spring 46'. When the plate has been inserted into the casing by a sufficient distance the aperture 10' is located immediately under the locking tooth 54 and thus the latch plate will be caused to pivot downwardly under the influence of the spring 24'. Thus the rearwardly extending arm portions 52, 53 will be moved to a level beneath the downwardly extending projections 47' and the slider 5' will be able to move forwardly to the position illustrated in FIG. 15. Since the latch plate has pivotted downwardly the locking tooth 55 is engaged with the aperture 10' thus preventing the plate 7' from being withdrawn from the buckle. Also the downwardly directed protrusions 47' are located immediately above the free ends of rearwardly extending arm portions 52, 53 thus preventing the latch plate from pivoting to a released position even if the buckle is subjected to a shock in the direction of arrow 48'.

When it is desired to release the plate 7' from the buckle the slider 5' is pressed inwardly against the biassing effect of spring 19', thus moving the protrusions 47' away from their positions over the free ends of arms 52, 53, and since the head 32' of the hook shaped member 30' is retained within the camming slot 33' the hook shaped member will be caused to rotate about the axle 56 and since the free ends of the rearwardly extending arm portions 52, 53 are located within the recesses 31' defined by the hook shaped members 30' the hook shaped members will lift the free end portions of the rearwardly extending arm portions 52, 53 thus causing the latch plate 54 to pivot about the point 37' thus retracting the locking tooth from the aperture 10, enabling the ejector 44' to eject the plate 7' under the biassing effect of spring 46', and returning the buckle to the position illustrated in FIGS. 10 and 14.

Again it will be noted that in this embodiment of the invention the buckle will be able to withstand forces applied in the direction of arrow 48' without releasing the plate, but the buckle may still be operated simply and in a straightforward manner.

What is claimed is:

1. A buckle for holding a plate having an aperture or notch and means by which it can be attached to a vehicle safety belt or harness, said buckle comprising a casing which has a mouth into which can be placed that part of the plate which carries the aperture or notch, a latch plate movably mounted within the casing which includes a tooth to engage said aperture or notch to secure the plate in position, and a projection on the latch plate, the projection having a top and a side, and a release mechanism including a slider which is slidably mounted in the casing and having at least one lever which is operated by the slider and a protrusion having a bottom and a side and mounted on the slider to abut the latch plate projection, the lever operating to swing the latch plate to move the tooth out of the said aperture or notch, the arrangement being such that the slider can slide from a first position with the top of the projection closely adjacent the bottom of the protrusion in which, when the latch plate is in a securing position to retain said plate in position, to a second position with the side of the projection abutting the side of the protrusion in which the plate is moved from the securing position to a release position to release the plate, the arrangement being such that when the slider is in the first position and the latch plate is in the securing position the spacing between the projection top and the protrusion bottom being such that unyielding abutting contact between the projection and the protrusion will occur to prevent the latch plate moving from the securing position.

2. A buckle according to claim 1 wherein when the plate is locked within the buckle the surface of the plate nearer the slider is nearer to the slider than is the end of the lever remote from the slider.

3. A buckle according to claim 1 wherein a spring biased ejector is provided tending to eject the plate from the buckle, the ejector lying under the said tooth when the plate is not in the casing, retaining the latch plate in the release position.

4. A buckle according to claim 1 wherein the slider slides in a direction parallel to the plane of the plate, and said protrusion may engage a portion of the latch plate when the latch plate is in the release position, thus retaining the slider in a retracted position.

5. A buckle according to claim 1 wherein the lever is hook shaped.

6. A buckle according to claim 1 wherein the buckle has a channel member, a mounting rod carried in holes defined in the walls of the channel, and two levers mounted on the rod to be outside the walls of the channel and engaging arms on the latch plate which arms pass through apertures in the walls of a channel.

7. A buckle according to claim 6 wherein a portion of the latch plate adjacent the release mechanism includes arms of said latch plate.

8. A buckle according to claim 1 further including a spring mounted on said casing to bias the latch plate to a locking position, the spring also holding the latch plate against the walls of the channel member.

* * * * *